United States Patent [19]

Kratzer

[11] Patent Number: 4,520,769

[45] Date of Patent: Jun. 4, 1985

[54] ENGINE HEATING SYSTEM

[76] Inventor: John D. Kratzer, 125 Stearman, Erie, Colo. 80516

[21] Appl. No.: 635,405

[22] Filed: Jul. 30, 1984

[51] Int. Cl.[3] ..... F02N 17/02

[52] U.S. Cl. ..... 123/142.5 R; 237/12.3 C; 126/350 A; 126/365

[58] Field of Search ..... 237/12.3 B, 12.3 C; 126/361, 362, 350 A, 364, 365; 122/14, 17; 123/142.5 R, 179 H

[56] References Cited

U.S. PATENT DOCUMENTS 1,783,289 12/1930 Hopkins ..... 123/142.5 R 1,871,008 8/1932 Rentz ..... 123/142.5 R 2,180,663 11/1939 Bergeron et al. ..... 123/142.5 R 2,623,511 12/1952 Welin-Berer ..... 123/142.5 R

*Primary Examiner*—Henry Bennett

*Attorney, Agent, or Firm*—Klaas & Law

[57] ABSTRACT

An engine preheating system comprising a pair of oppositely disposed burner devices operated by propane gas, a pair of oppositely disposed cylindrical combustion chambers with a cylindrical coolant jacket therearound, and a central cylindrical stack connected to the combustion chambers with a coolant jacket therearound connected to the other coolant jacket.

8 Claims, 2 Drawing Figures

ENGINE HEATING SYSTEM

BACKGROUND & SUMMARY

This invention relates to engine heating systems, and more particularly to a propane gas operated auxiliary heating system and heater apparatus.

There have been numerous attempts to develop an auxiliary engine heating system and heater apparatus as exemplified by U.S. Pat. Nos. 2,627,258; 2,681,052; 2,737,169; 3,131,864; 3,277,886; 3,304,004; 3,400,700; 3,861,590; 4,051,825; 4,268,248; 4,289,095; 4,305,354; 4,348,992; 4,381,742; and 4,392,609.

The present invention comprises a relatively small size low weight highly efficient continuously operable heater apparatus operated by propane gas and connected to an engine cooling system by hoses and quick-disconnect coupling means. The heating system heats a fluid by use of a supply gas which comprises the following elements: (1) an elongated heater tube means having a central longitudinal axis mounted in a horizontal attitude including concentrically mounted horizontally extending outer tube means and inner tube means divided by central plate means and closed by end plate means for providing a pair of oppositely disposed combustion chambers and an outermost fluid chamber surrounding the combustion chambers; (2) an elongated stack tube means having a central longitudinal axis centrally mounted on said elongated heater tube means in a vertical attitude including concentrically mounted vertically extending outer tube means connected to the horizontally extending outer tube means and vertically extending inner tube means connected to said horizontally extending inner tube means with an end plate means mounted therebetween for providing a vertically extending fluid chamber connected to the horizontally extending fluid chamber in circumjacent relationship to a vertically extending exhaust chamber connected to each of the pair of oppositely disposed combustion chambers; (3) an exhaust cap means mounted on the upper end of the elongated tubular stack means for providing an enlarged exhaust chamber opposite the vertically extending exhaust chamber and having exhaust outlet port means therein for discharging exhaust gas and air inlet port means for entrance of air to the enlarged exhaust chamber; (4) a pair of oppositely disposed gas burner means mounted on opposite ends of the elongated tubular heater means for simultaneously supplying a combustible air-gas mixture to and simultaneously burning a combustible air-gas mixture in each of the oppositely disposed combustion chambers; (5) low temperature fluid inlet means for connecting the outermost horizontally extending fluid chamber means to a relatively low temperature body of fluid in a fluid storage means and for continuously supplying and filling said outermost horizontally and vertically extending fluid chamber means with fluid during operation of the heating system; and (6) high temperature fluid outlet means for connecting said vertically extending fluid chamber means to the fluid storage means and creating a flow of fluid into the horizontal fluid chamber means and laterally around each of the oppositely disposed combustion chambers and then upwardly through the vertically extending fluid chamber means whereby the fluid is first heated in the horizontal fluid chamber means and subsequently further heated in the vertical fluid chamber means.

DETAILED DESCRIPTION

Figure 1:
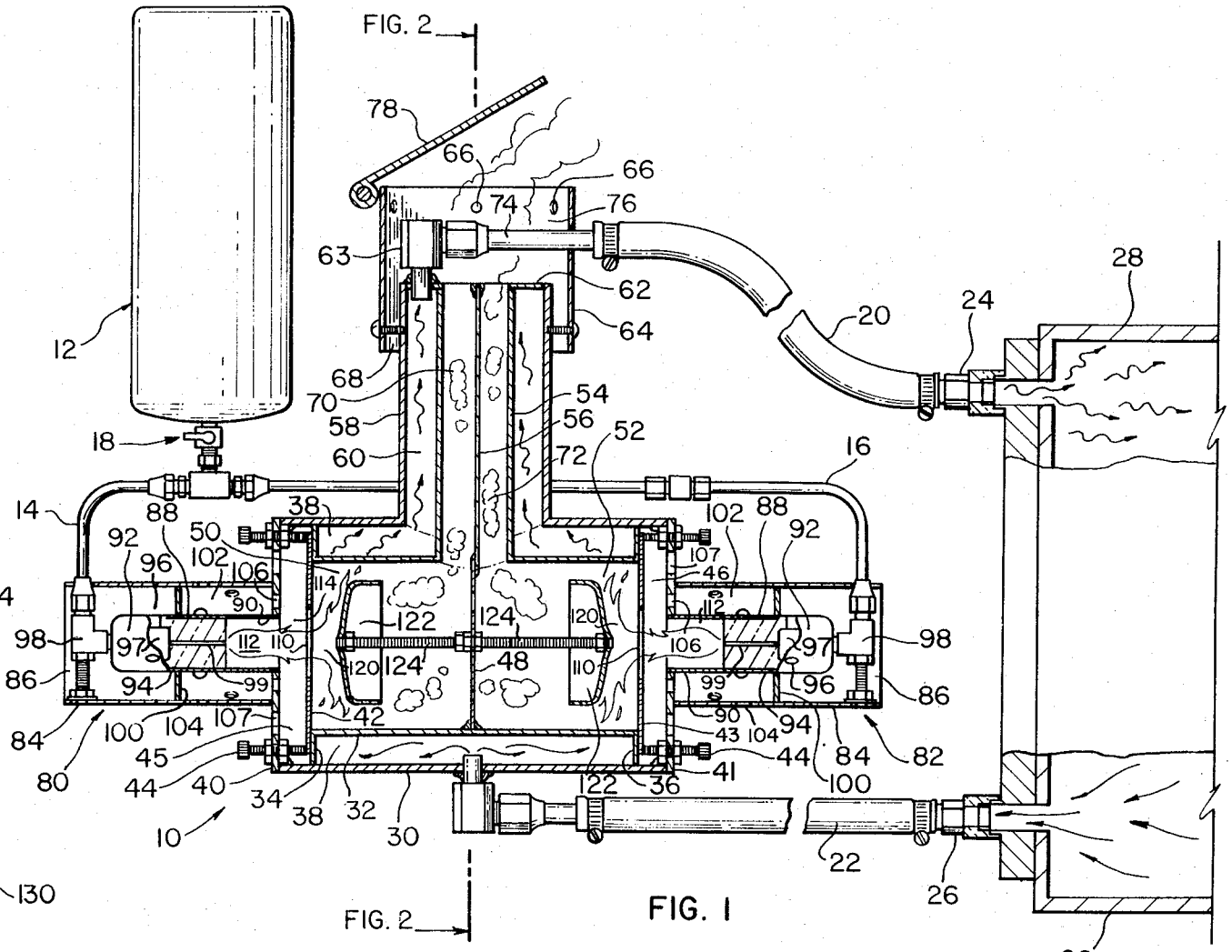
FIG. 1 is a schematic side elevational view of a system employing the invention.

Referring to FIG. 1, the system comprises a heater apparatus means 10; a pressurized propane gas tank supply means 12 connected to opposite ends of the heater apparatus by connecting tube means 14, 16 through a flow control valve and regulator means 18; and coolant outlet and coolant inlet hose means 20, 22 having quick connect-disconnect coupling means 24, 26 for connection to upper and lower level portions 28, 29 of the coolant system of a deisel or gasoline internal combustion engine or to other hose means connected to the engine.

Figure 2:
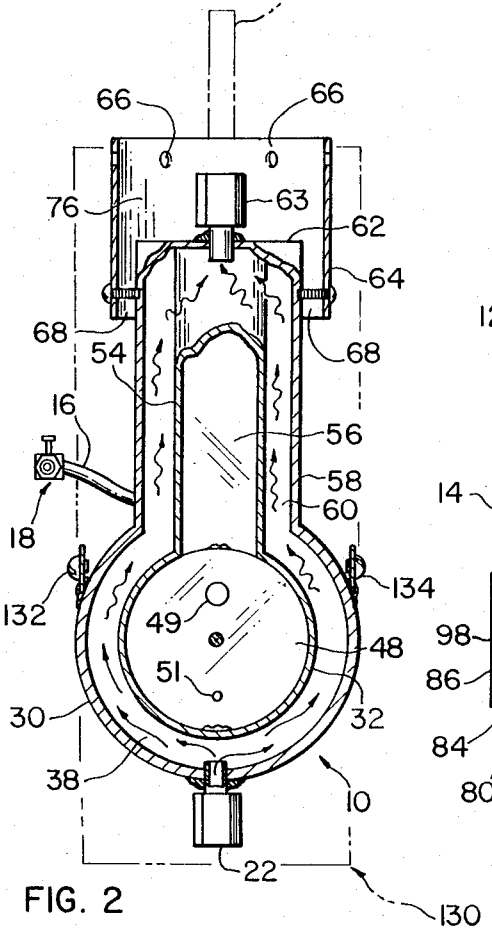
FIG. 2 is a cross-sectional end view of the heater apparatus of FIG. 1 taken along line 2—2.

The heater apparatus means 10 comprises a relatively small size (e.g., 7×4 inch) outer one piece tube means 30 and a relatively small size (e.g., 5×3 inch) inner one piece tube means 32 which has flared end flange means 34, 36, affixed (welded) to the outer tube means 30 to provide a closed coolant chamber means 38 circumjacent the inner tube means. Outer end plate means 40, 41 are removably affixed to opposite end portions of the outer tube means and inner end plate means 42, 43 are removably held against flange portions 34, 36 by bolt means 44 to provide cylindrical primary combustion chamber means 45, 46, therebetween. Central cylindrical plate means 48 affixed (welded) to inner tube means 32 and inner end plate means 42, 43, provide divided cylindrical combustion chamber means 50, 52 connected to an inner tubular exhaust gas stack means 54 which may be divided by a plate means 56. Ports 49, 51 may be provided in central plate means 48. An outer tubular coolant jacket means 58 is mounted circumjacent stack means 54 to provide a coolant passage means 60 connected to coolant chamber means 38. An end plate means 62, FIG. 2, is affixed to tubular means 54, 58 to close the end of coolant passage means 60 which is connected to coolant outlet means 20 through a coupling means 63. A cylindrical cap means 64 having lateral exhaust passages 66 and lower air inlet passage means 68 is mounted on the end of tubular means 58 in open communication with exhaust gas passage means 70, 72 in stack tubular means 54. A portion 74 of coolant outlet hose means 20 extends through exhaust chamber means 76 in cap means 64. A stack cover lid 78 is pivotally mounted on cap means 64 for movement between an open position and a closed position.

Gas burner means 80, 82 are mounted on opposite ends of the burner apparatus. Each burner means comprises a tubular outer housing member 84 fixedly mounted at one end on end plates 40, 42 and having an opposite open cylindrical air inlet portion 86. A cylindrical inner burner tube means 88 is mounted in housing member 84 with an inner open end portion 90 mounted in a circular central opening in plates 40, 41. A conventional cylindrical blow torch type flame device 92 is mounted in and closes opposite end portion 94 of tube means 88. Flame device 92 is provided with a plurality of circumferentially spaced air inlet openings 96 connected to atmosphere through opening 86 and to a central air-gas mixing chamber 97 connected to supply gas lines 14, 16 through couplings 98. A venturi jet-type passage means 99 discharges a jet stream of air-gas mixture from chamber 97 into the front portion of tube 88 and into combustion chambers 45, 46 & 50, 52. A baffle plate means 100 is fixedly mounted between burner tube means 88 and housing means 84 to provide a secondary air chamber means 102 while preventing flow of air from primary air opening 86 to the secondary air chamber means. A plurality of circumferentially spaced secondary air inlet passages 104 are provided in housing 84 to allow flow of secondary air into chamber 102 and through a plurality of circumferentially spaced air holes 106 in end plates 40, 41 into combustion chambers 45, 46. In addition, a plurality of circumferentially spaced outer secondary air passages 107 in plates 40, 41 connect combustion chambers 45, 46 to the atmosphere.

The air-gas mixture in passage 99 flows into combustion chamber 46 through opening 90. When the air-gas mixture is ignited, the flame area extends beyond opening 90 into combustion chambers 50, 52 through central opening 110 in plates 42, 43. Opening 110 is substantially larger (e.g., $1\frac{1}{4}$ inch diameter) than opening 90 (e.g., $\frac{7}{8}$ inch diameter) but substantially smaller than the diameter of inner tube 32 (e.g., $2\frac{1}{4}$ inch) to enable the flame to extend therethrough into combustion chambers 50, 52. A cup-shape heat deflection and anti-flame out baffle means 122 having an outside diameter of approximately $2\frac{3}{4}$ inches is mounted opposite opening 110 (approximately $1\frac{1}{4}$ inches therefrom) and is supported by a rod means 124 fixed to central plate means 48.

In operation, valve means 18 is opened to allow propane gas to flow to both burner means 80, 82 and upwardly through stack means 54 where it is ignited by a match or lighter or the like with lid 78 open. After the stack gas is ignited, the flame will follow the air-gas mixture back to chambers 45 and 46 and 50, 52 whereafter a steady state flame will be established and maintained at flame areas 112, 114, 120 opposite each torch device until the supply of gas is shut off by closing valve means 18. Heat generated in chambers 50, 52 will heat coolant in chamber 38 causing flow of coolant up coolant passage 70 and into coolant outlet hose 20 for delivery to the engine. The heat from stack means 54 will further heat the coolant in circumjacent coolant passage means 60. The coolant is further heated by the exhaust gas in cap chamber 76 during passage through coolant hose portion 74. Thus, the efficiency of the system is greatly increased. In continuous operation, the flame is confined to flame areas 112, 114, 120 by baffle means 122 which also causes turbulence of exhaust gases in chambers 50, 52 so that the walls of inner burner tube means 32 are thoroughly heated with maximum efficiency. The combustion chamber and stack parts are preferably made of stainless steel. The size and weight (approximately 10 to 15 pounds without the propane tank) of the apparatus is such as to enable the apparatus to be easily carried by hand so that a vehicle operator can store the apparatus in a vehicle compartment when not in use. Also, the apparatus may be permanently mounted in or adjacent to the engine compartment. The apparatus may be adapted for use with other devices such as hot water heaters or the like. The apparatus provides a wide range of heat settings from 2000 to 30,000 BTU and is operable in cold (e.g., −60° F.) and windy conditions at high altitudes (e.g., 11,100 feet). LP gas in various size cylinder tanks (e.g., 14 ounce, 16 ounce, 6 pounds or larger) may be used. Small size tanks may be mounted in juxtaposition (e.g., along the stack) to preheat the gas for maximum efficiency. The regulator means permits adjustment for 0 to 100 pounds. The heater apparatus is operable at low pressures (e.g. 2 pounds) or high pressures (e.g. 100 pounds) depending upon heating equipment. The apparatus may be mounted in a lightweight shroud-type carrying and support frame means 130 (shown in phantom in FIG. 2) by fastening means 132, 134 with a handle means 136 provided at the top.

While an illustrative and presently preferred embodiment of the invention has been shown and described herein, it is to be understood that the appended claims are intended to cover alternative embodiments except insofar as limited by the prior art.

What is claimed is:

1. A heating system for heating a fluid by use of a supply gas comprising:

an elongated heater tube means having a central longitudinal axis mounted in a horizontal attitude including concentrically mounted horizontally extending outer tube means and inner tube means divided by central plate means and closed by end plate means for providing a pair of oppositely disposed combustion chambers and an outermost fluid chamber surrounding said combustion chambers;

an elongated stack tube means having a central longitudinal axis centrally mounted on said elongated heater tube means in a vertical attitude including concentrically mounted vertically extending outer tube means connected to said horizontally extending outer tube means and vertically extending inner tube means connected to said horizontally extending inner tube means with an end plate means mounted therebetween for providing a vertically extending fluid chamber connected to said horizontally extending fluid chamber in circumjacent relationship to a vertically extending exhaust chamber connected to each of said pair of oppositely disposed combustion chambers;

a pair of oppositely disposed gas burner means mounted on opposite ends of said elongated tubular heater means for simultaneously supplying a combustible air-gas mixture to and simultaneously burning a combustible air-gas mixture in each of said oppositely disposed combustion chambers;

low temperature fluid inlet means for connecting said outermost horizontally extending fluid chamber means to a relatively low temperature body of fluid in a fluid storage means and for continuously supplying and filling said outermost horizontally and vertically extending fluid chamber means with fluid during operation of the heating system; and high temperature fluid outlet means for connecting said vertically extending fluid chamber means to the fluid storage means and creating a flow of fluid into said horizontal fluid chamber means and laterally around each of said oppositely disposed combustion chambers and then upwardly through said vertically extending fluid chamber means whereby the fluid is first heated in said horizontal fluid chamber means and subsequently further heated in said vertical fluid chamber means.

2. The invention as defined in claim 1 and further comprising:

an exhaust cap means mounted on the upper end of said elongated tubular stack means for providing an enlarged exhaust chamber opposite said vertically extending exhaust chamber and having exhaust outlet port means therein for discharging exhaust gas and air inlet port means for entrance of air to said enlarged exhaust chamber.

3. The invention as defined in claim 1 and further comprising:

baffle means mounted in each of said pair of combustion chambers for establishing a first flame area between said end plate means at the opposite ends of said outer horizontally extending tubular means and said end plate means at the opposite ends of said inner horizontally extending tubular means and for establishing a second flame area between said end plate means at the opposite ends of said inner horizontally extending tubular means and baffle means and for establishing an exhaust gas chamber between said baffle means and said central dividing plate means.

4. The invention as defined in claim 3 and wherein:

said air-gas mixture inlet opening in said outer end plate means is of smaller diameter than said flame opening in said inner end plate means;

said flame opening is of smaller diameter than said flame baffle means; and said flame baffle means is axially inwardly spaced from said flame opening a distance approximately equal to the diameter of said flame opening.

5. The invention as defined in claims 3 or 4 and wherein said oppositely mounted burner means comprising:

an inner tubular means defining an elongated air-gas passage means for receiving an air-gas mixture at the axially outermost end portion thereof and for discharging the air-gas mixture into the combustion chamber means through a discharge opening at the axially innermost end portion thereof;

an outer tubular means mounted circumjacent said inner tubular means and defining an inlet air chamber thereabout and having an open ended axially outermost end portion for supply of primary combustion air through said axially outermost end portion of said inner tubular means and having an open ended axially innermost end portion fixed to said axially outermost end plate means;

a separating plate means mounted between said innermost tubular means and said outermost tubular means for providing a secondary air chamber without connection to said air inlet end portion of said outer tubular means;

a plurality of air inlet port means in said outer tubular means opposite said secondary air chamber means for supplying secondary air thereto; and a plurality of secondary air outlet port means in said outermost end plate means for connecting said secondary air outlet port means to said combustion chamber means opposite said first flame area.

6. The invention as defined in claim 2 and wherein:

said fluid outlet means including a portion extending through said exhaust gas chamber in said exhaust cap means.

7. The invention as defined in each of claims 1, 2, 3 or 4 and wherein said gas is a pressurized tank of propane gas.

8. The invention as defined in each of claims 1, 2, 3 or 4 and wherein said fluid is coolant of an internal combustion engine.

* * * * *